US008246080B1

(12) United States Patent
Bennett

(10) Patent No.: US 8,246,080 B1
(45) Date of Patent: Aug. 21, 2012

(54) FOLDABLE COMPARTMENTALIZED CLIPBOARD

(76) Inventor: Bridget Renee Bennett, Desoto, TX (US)

( * ) Notice: Subject to any disclaimer, the term of this patent is extended or adjusted under 35 U.S.C. 154(b) by 503 days.

(21) Appl. No.: 12/459,971

(22) Filed: Jul. 10, 2009

(51) Int. Cl.
*B42D 3/00* (2006.01)

(52) U.S. Cl. ..... 281/45; 220/500

(58) Field of Classification Search ..... 281/45–51; 220/9.2, 9.1, 524, 523, 556, 555, 553, 500, 220/527; 206/232, 237, 472–475, 775
See application file for complete search history.

(56) References Cited

U.S. PATENT DOCUMENTS

| | | | | |
|---|---|---|---|---|
| 4,283,037 | A * | 8/1981 | Bindman | 248/447.2 |
| 6,637,774 | B2 * | 10/2003 | Gaska | 281/45 |
| 7,240,887 | B2 * | 7/2007 | Buote | 248/447 |
| 2007/0187565 | A1 | 8/2007 | Liptan | |

* cited by examiner

*Primary Examiner* — Edward Tolan
*Assistant Examiner* — Matthew G Katcoff

(57) ABSTRACT

A longitudinally foldable compartmentalized clipboard with a passageway for storing papers without creasing; The clipboard has a front side for writing with at least two frame members that are joined by a living hinge, and a releasable locking means including mating shapes formed into the frame members that couple with a friction fit when the case is opened in a writing position.

8 Claims, 10 Drawing Sheets

10'
12
48
16f
16
22
14
12f
14f
Reference
text text text te
text text text te
text text text te
text text text te
text text text te
text text text te
text text text te
text text text te
text text text te
text text text te
text text text te
text text text te
text text text te
text text text te
50
48
52a

FOLDABLE COMPARTMENTALIZED CLIPBOARD

CROSS REFERENCE TO RELATED APPLICATIONS

Not applicable

STATEMENT REGARDING FEDERALLY SPONSORED RESEARCH OR DEVELOPMENT

Not applicable

THE NAMES OF THE PARTIES TO A JOINT RESEARCH AGREEMENT

Not applicable

INCORPORATION-BY-REFERENCE OF MATERIAL SUBMITTED ON A COMPACT DISC

Not applicable

BACKGROUND OF THE INVENTION

Clipboards, constructed of various materials such as wood, masonite or plastic are well known in the art. Specialty containers with a clipboard component are also known in the art, while portfolio cases having a clipboard on the inside are common.

Lab inspectors, physicians and other hospital personnel for example, use clipboards on their rounds in order to take notes, file reports and the like. Although conventional clipboards work adequately for their intended use, they are bulky and inconvenient because the individual on rounds is frequently required to lay the clipboard aside in order to assess a patient, among other tasks. Normally, attending physicians, residents, medical students and personnel at semiconductor plants wear lab coats with pockets. It would be advantageous to such individuals to possess a clipboard case that folds so as to be stored within a lab coat pocket, and which has a capacity to store multiple papers.

SUMMARY OF THE INVENTION

The instant invention is directed generally to a specialty compartmentalized clipboard, and more specifically to a compartmentalized folding clipboard. The compartmentalized folding clipboard; hereinafter, foldable clipboard, may be thought of as a pair of hollow sections, each member of the pair having a front and rear surface and joined together along one side by a hinge, so that the sections fold both away from each other to form a flat surface for writing, and toward one another in order to fit in a typical lab coat waist pocket. Ideally, the hollow sections are at least partially constructed of lightweight injection molded plastic or blow molded plastic and are connected one to the other by at least one living hinge. The section pair may be molded unitarily complete with the writing surfaces and the living hinge joining the pair, or each section may be molded separately and joined by an attached living hinge. Preferably each member of the section pair is frame member with the front writing surfaces added separately, a hollow remaining between the front and rear surfaces. Each of the pair has the same area of writing surface. The section pair forms a unified writing surface when opened to a writing position to accommodate standard-sized 8½ inch by 11 sheets of paper atop the unified writing surface and an uninterrupted passageway beneath the writing surface for the containment of paper stock in the compartment within. At least one of the members of the section pair has an opening that allows for the insertion of paper stock into the passageway. It should be understood however that the clipboard may be sized to accommodate other sizes of paper stock.

One object of the present invention is to provide a foldable clipboard that will fit into a lab coat pocket when folded.

Another object of the present invention is provide a foldable clipboard that is capable of retaining a writing position with a releasable locking means.

Another object of the present invention is to provide a means of securing papers and other articles within the body of the foldable clipboard.

Another object of the present invention is to hold papers within the body of the foldable clipboard without creasing the papers.

Another object of the present invention help keep papers from environmental or workplace contamination.

Other objects and advantages of the present invention will become apparent from the following descriptions, taken in connection with the accompanying drawings and charts, wherein by way of illustration and example, a preferred embodiment of the present invention is disclosed.

DETAILED DESCRIPTION OF THE INVENTION

Listing of Numbered References

Figure 2:
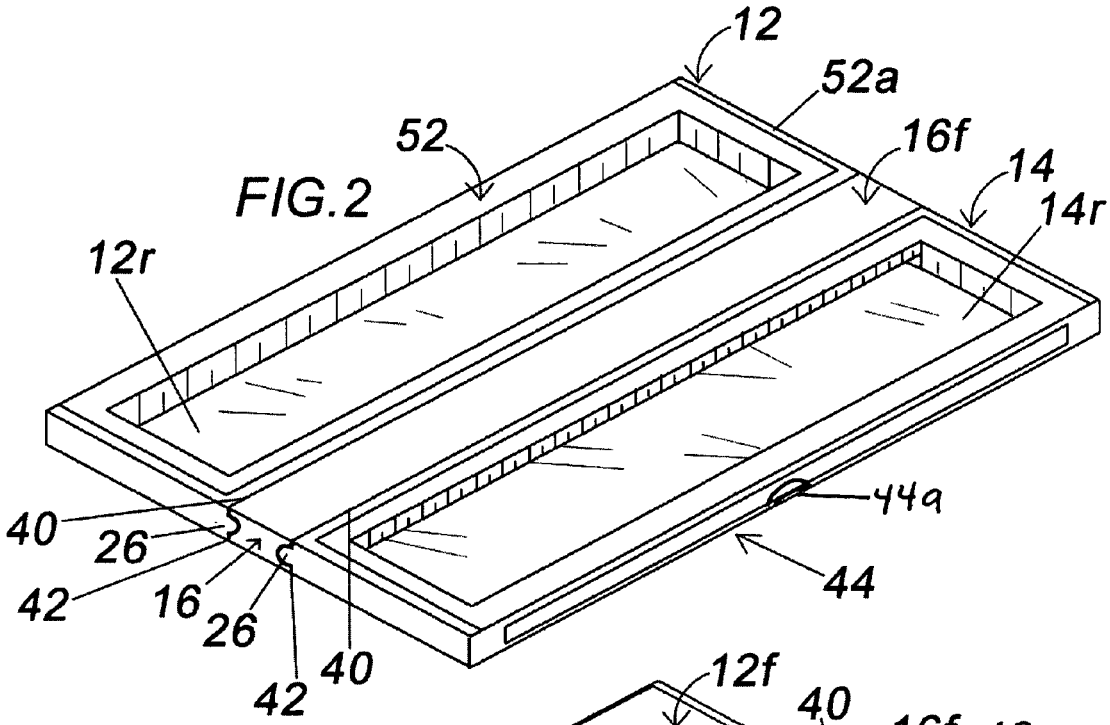
FIG. 2 is an isometric top view of the embodiment of FIG. 1 according to the present invention with the writing surfaces removed.
Figure 3:
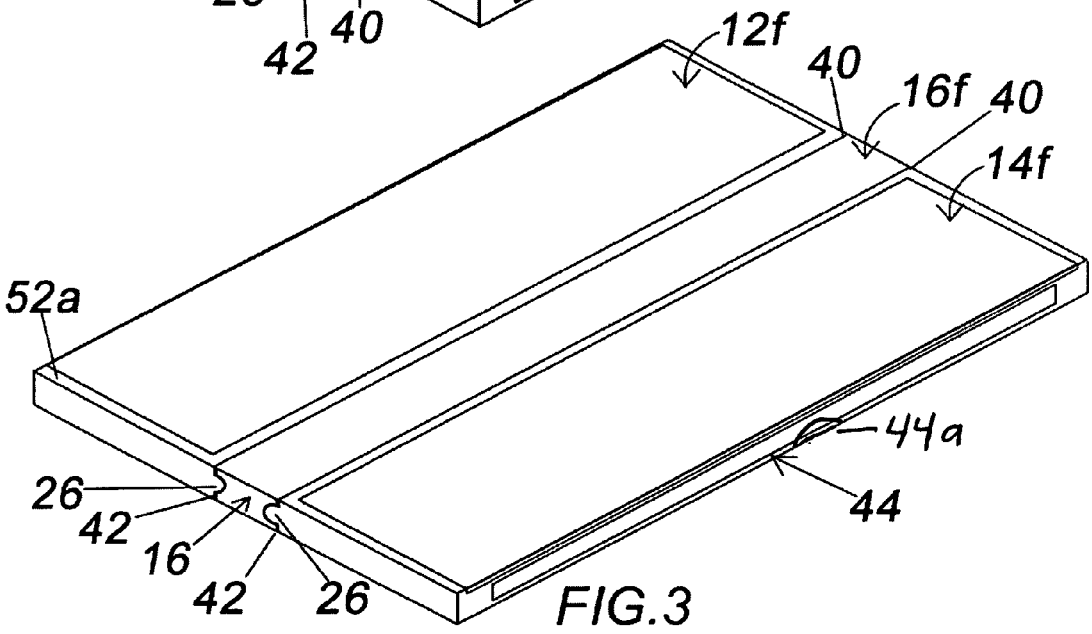
FIG. 3 is an isometric top view of an embodiment according to the present invention open for writing having the writing surfaces in place.
Figure 8:
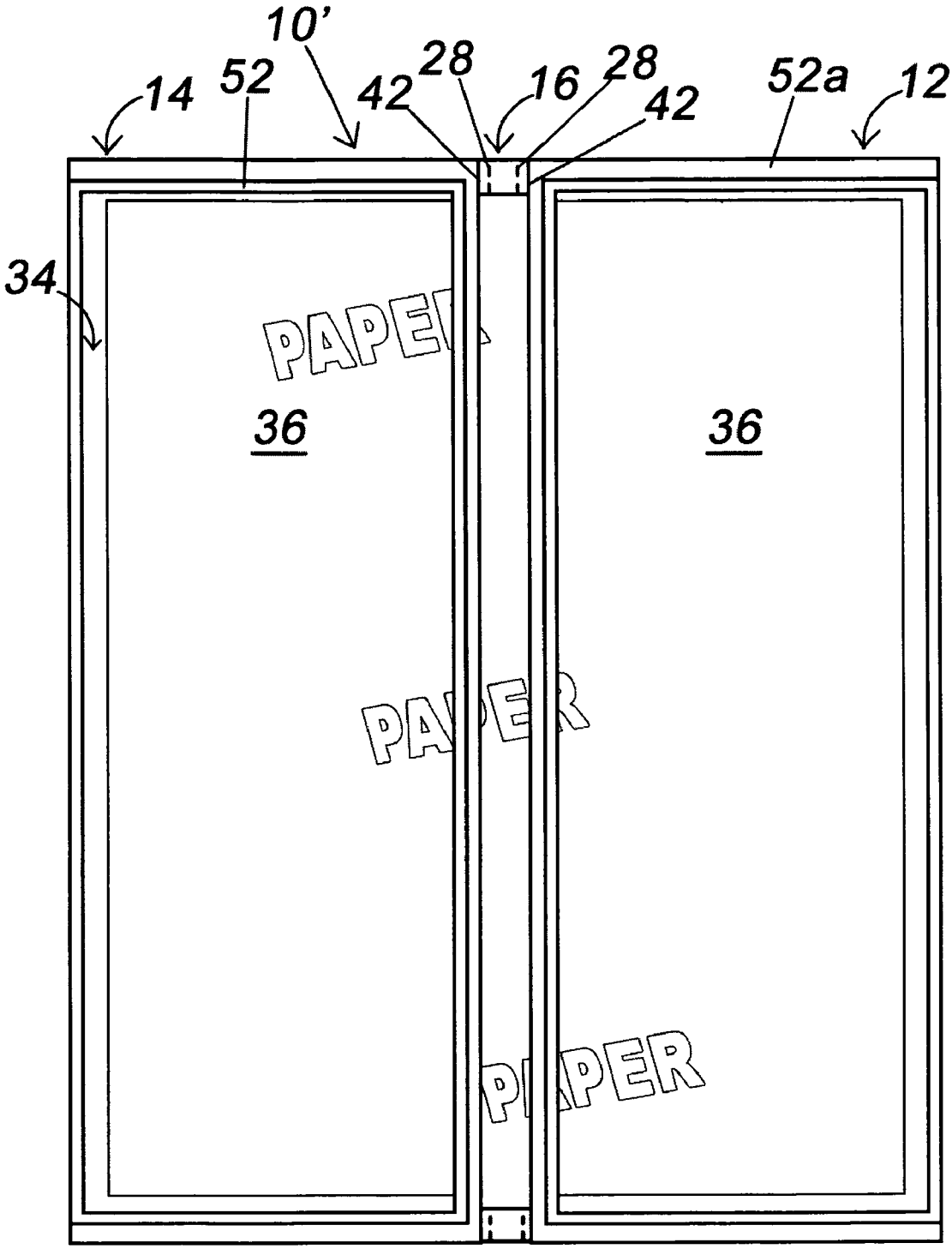
FIG. 8 is a plan view of the rear side of the embodiment of FIG. 1.
Figure 9:
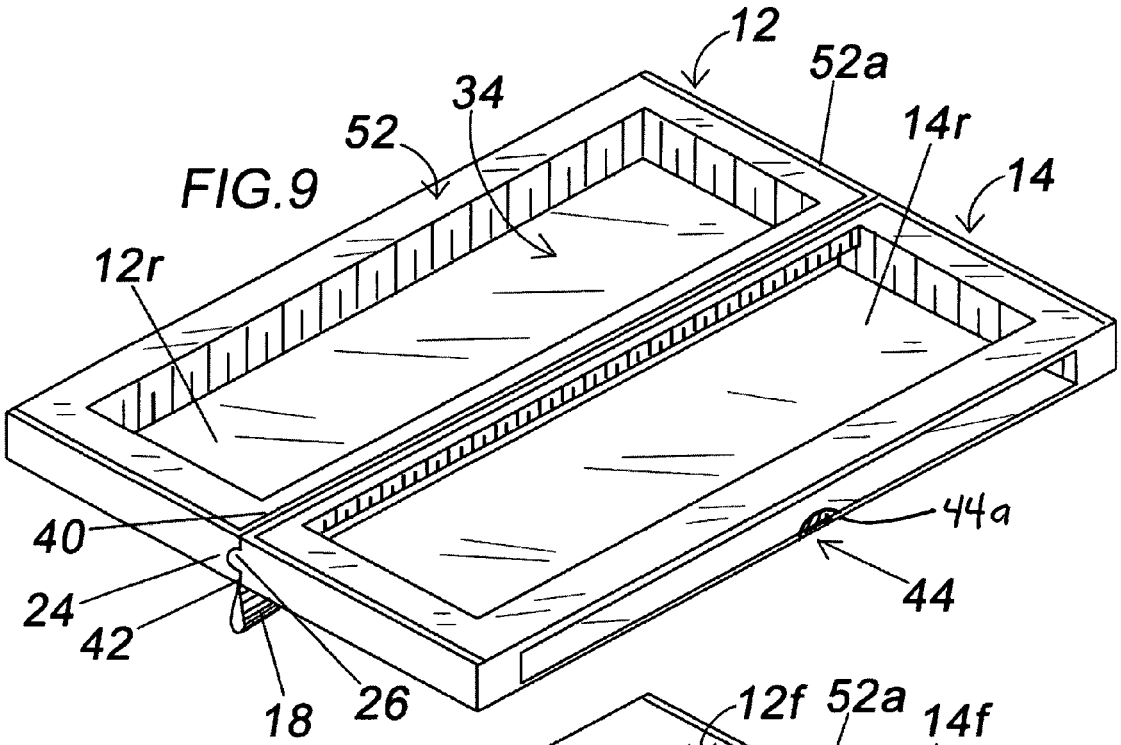
FIG. 9 is an isometric top view of another embodiment according to the present invention with the writing surfaces removed.
Figure 10:
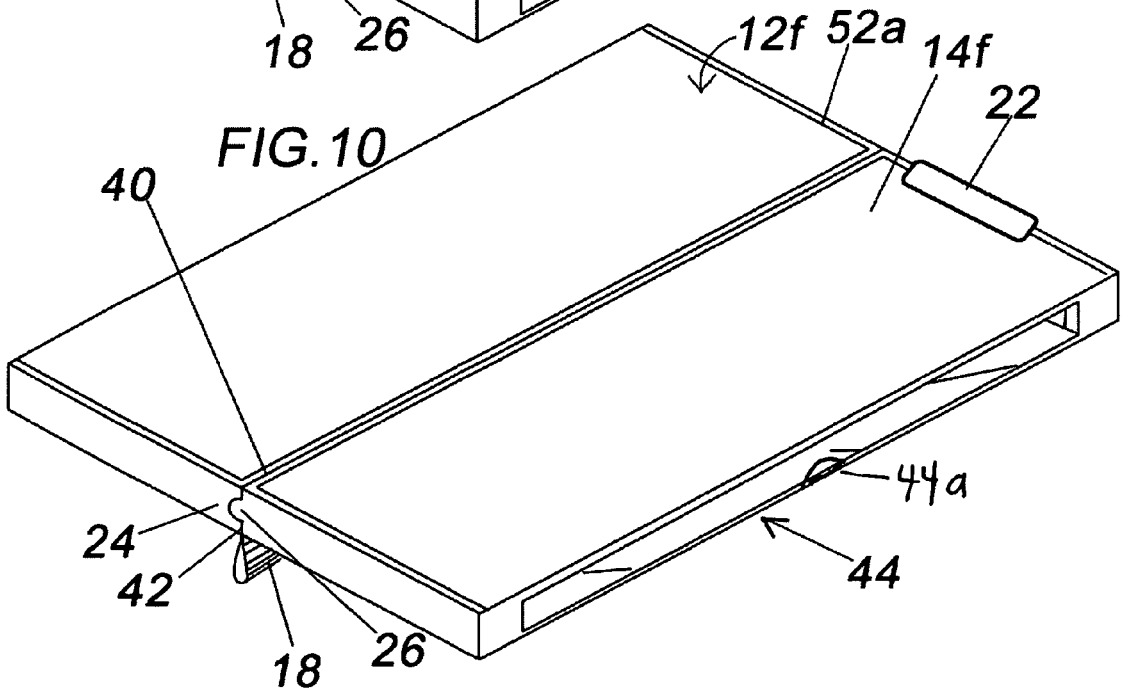
FIG. 10 is an isometric top view of the embodiment of FIG. 9 according to the present invention open for writing with the writing surfaces in place.
Figure 11:
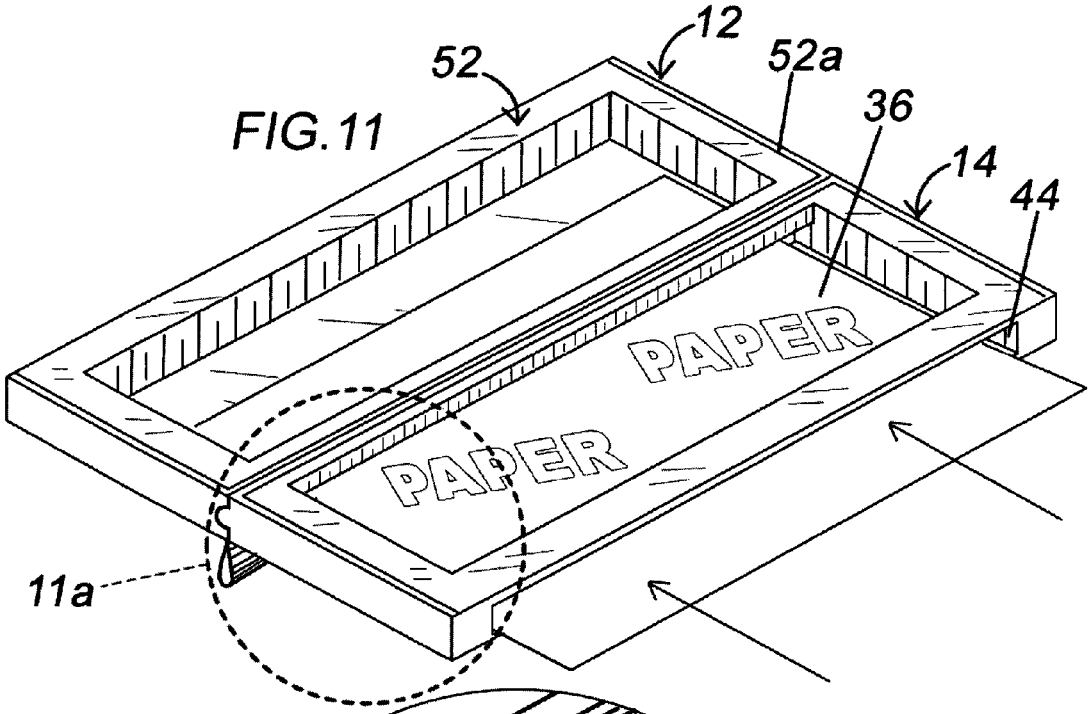
FIG. 11 is an isometric top view of another embodiment according to the present invention with the writing surfaces removed showing the insertion of paper through an opening in the right frame member.
Figures 12, 13, 14:
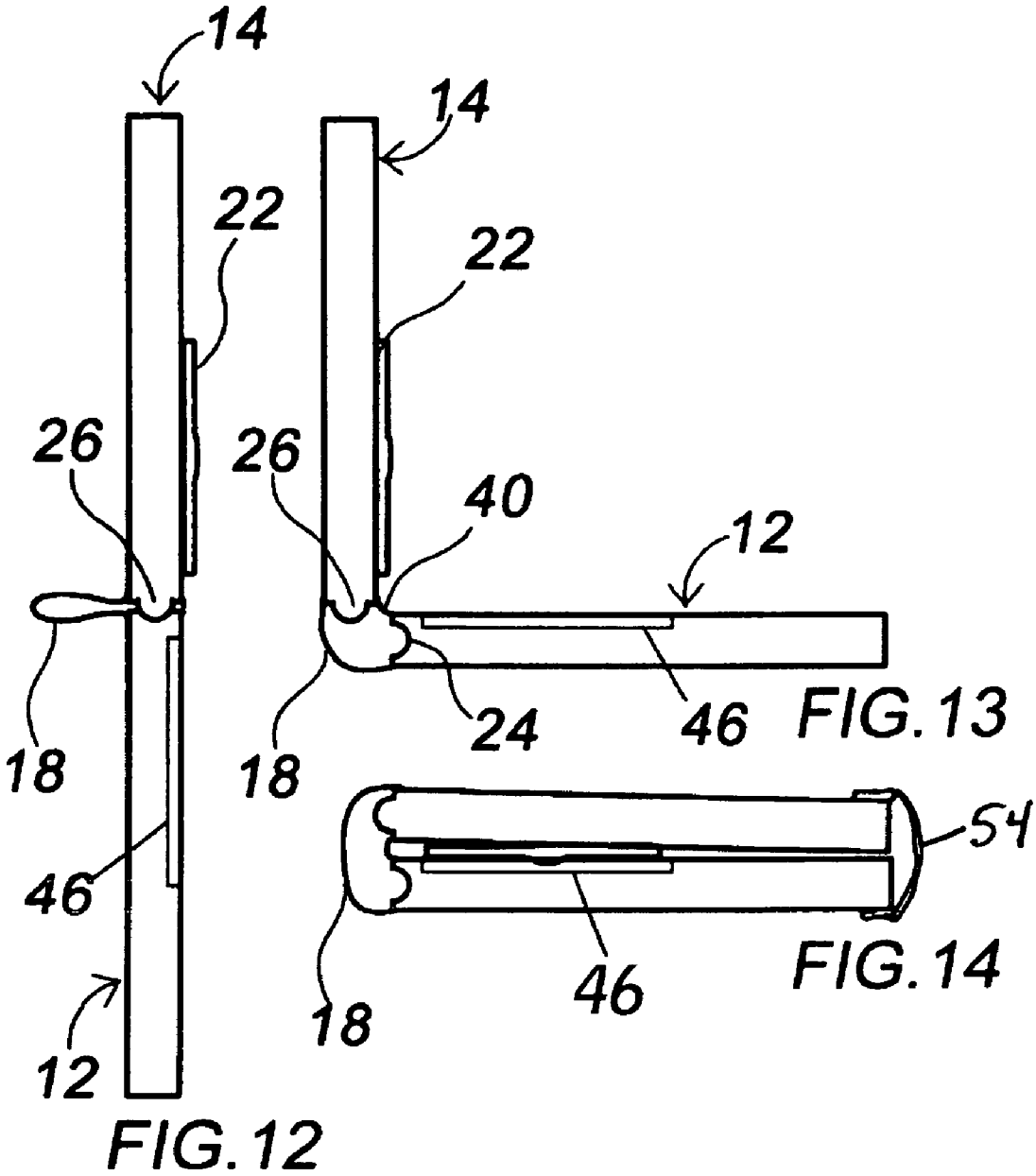
FIG. 12 is an edge view of the embodiment shown in FIG. 10, open in the writing position.
FIG. 13 is an edge view of another embodiment shown in FIG. 10, open to 45 degrees.
FIG. 14 is an edge view of another embodiment shown in FIG. 10, closed completely.

10' foldable clipboard
12 left frame member
14 right frame member
16 center frame member
12*f* writing surface left frame member
14*f* writing surface right frame member
16*f* writing surface center frame member
12*r* left rear surface
14*r* right rear surface
18 deformable cover
20 cut-away
22 spring clip for holding paper
24 concavity
26 convexity
28 mating line
34 compartment
36 paper stock
40 hinge
42 section separation
44 opening
44*a* opening
46 spring clip recess
48 sleeve
50 reference media
52 section recess
52*a* panel lip
54 closure Referring generally to FIGS. 1-16, a compartmentalized folding clipboard is shown according to the present invention, including a foldable compartment having a pair of frame members surfaced for writing purposes, with a center frame member that is hingeably joined to two adjacent outer frame members with at least one hingeable join between the frame members preferably being a living hinge of substantially the same material as the frame members as expressed in the embodiment shown in FIGS. 9-15. Each of the two outer frame members 12, 14 has a writing surface 12*f*, 14*f* respectively, and a rear surface 12*r*, 14*r* respectively. Separating the writing surface and rear surface of each outer frame member is a frame periphery that produces a space between the surfaces that defines a compartment 34 suitable for the storing of paper. Unlike frame members 12, 14 center frame member 16 has no corresponding rear surface, but writing surface 16*f* is joined to the two adjacent frame members 12, 14 by at least one hinge 40 such as a living hinge, but it should be understood that a piano-type hinge may also be employed. As best seen in FIG. 2 and FIG. 3, when the compartmentalized clipboard is opened flat for use, it is releasably secured into the writing position by a locking means that includes mateable shapes molded into the frame members 12, 14 and center frame member 16 that produce a friction fit when snapped together. Preferably the shapes are concavities 24 mated with convexities 26, although other shapes such as rounded squares and rounded rectangles (not shown) mated with corresponding recesses may be used. As shown in FIG. 8, and indicated by the hidden lines, the mate-able shapes are at the center top and bottom of the frame members. In FIG. 9 the compartmentalized folding clipboard is opened to a writing position where the aligned compartments 34 create an unobstructed passageway for the admittance of media such as paper stock that is inserted into the compartment through an opening 44 along one edge of a frame member. As shown in FIG. 13 and FIG. 14, frame members 12, 14 fold together for storage along the hinge line and any paper within the compartment is folded without creasing. A deformable cover 18, most preferably of the same material as the frame members and attached to the outer frame members only, spans the gap between the rear surfaces 12*r*, 14*r* of the frame members.

Figure 4:
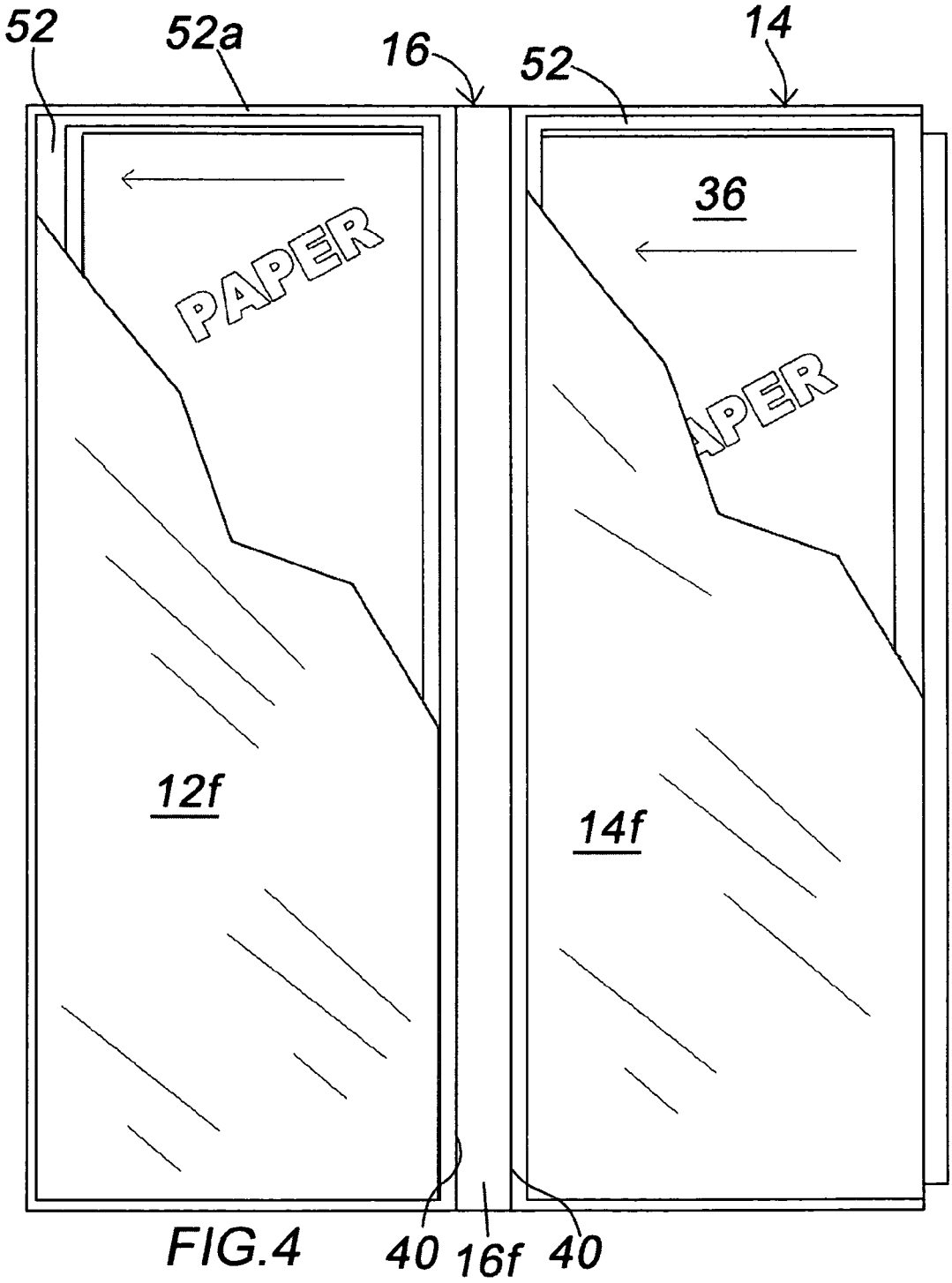
FIG. 4 is a plan view of the front side of the embodiment of FIG. 1 with a portion of the writing surfaces removed, revealing a compartment filled with paper beneath.
Figure 5:
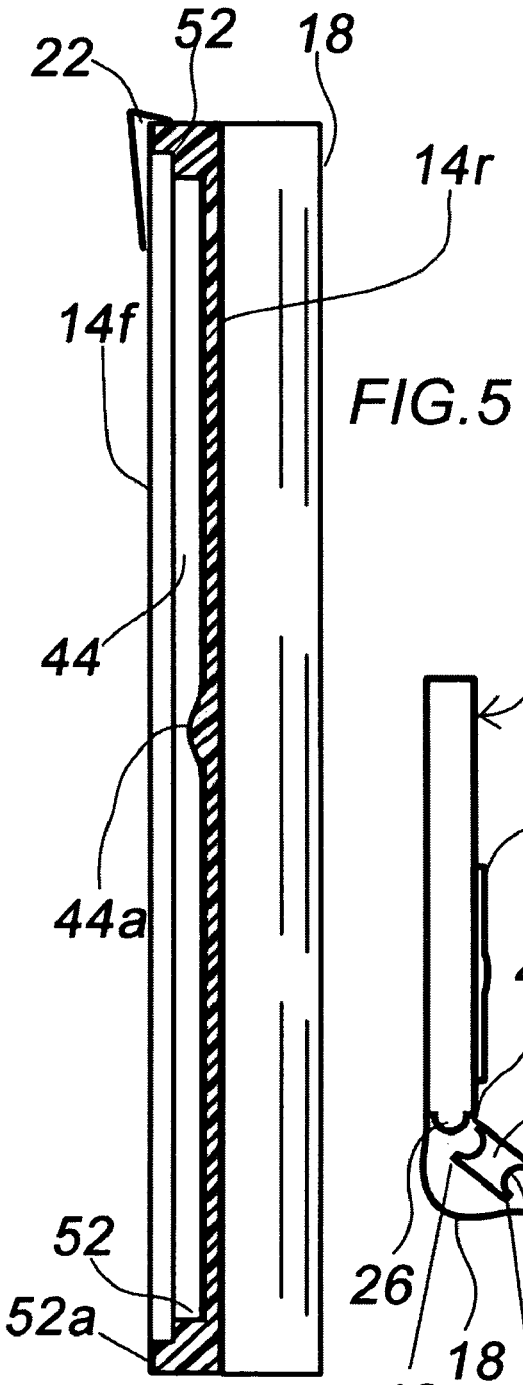
FIG. 5 is a sectional view of the embodiment of FIG. 1 according to the present invention open in the writing position taken along lines 11'-11' of FIG. 1.
Figure 6:
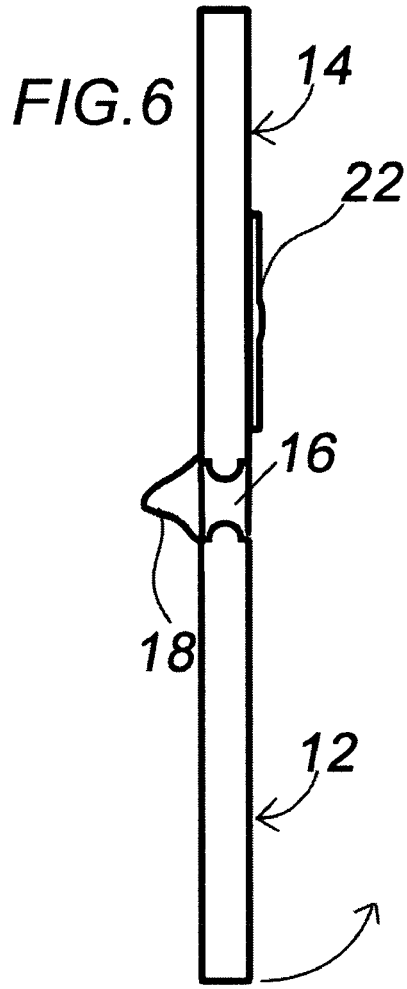
FIG. 6 is an edge view of the embodiment of FIG. 1 according to the present invention open in the writing position.
Figure 7:
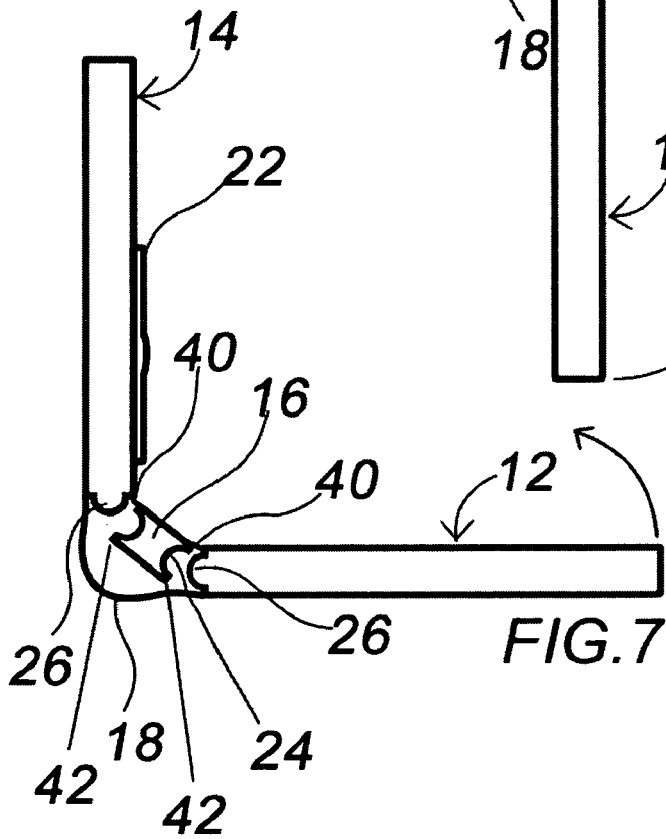
FIG. 7 is an edge view of the embodiment of FIG. 1 according to the present invention open to 90 degrees.

The embodiment shown in FIGS. 1-8 has a pair of concavities 24 molded into the center frame member 16 to mate with a pair of convexities 26 molded into adjacent frame members 12, 14 when opened for writing. FIG. 4 shows a portion of the writing surfaces 12*f*, 14*f* of the two sections removed, with an opening 44 along one side to, permit the admittance of papers into compartment 34. A lip 44*a* is molded along an edge of the opening 44 in order to prevent papers from falling out of the compartment when the device is opened flat for writing and moved about. The lip may be rigid or flexible, and may be fixed in place or folded into a vertical position by means of a living hinge (not shown) between the lip 44*a* and the right rear surface 14*r*.

Figure 11A:
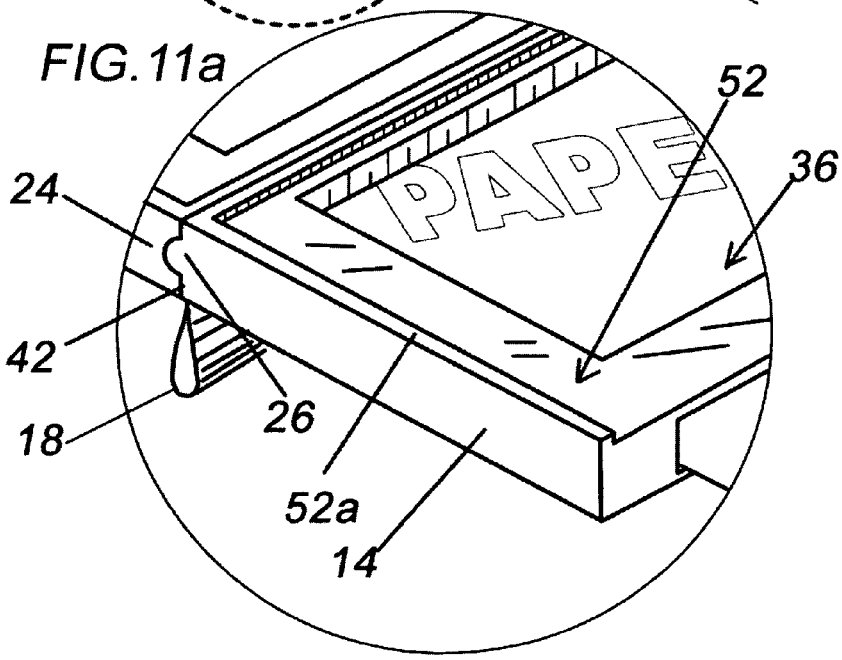
FIG. 11A is a detail view showing the raised peripheral edge 52*a* about the top of one section, producing a recess 52 for the seating of a writing surface.

The embodiment according to the present invention shown in FIGS. 9-13 has the center frame member of the former embodiment reduced to a living hinge, the two outer frame members 12, 14 joined longitudinally by the single living hinge 40 producing a unified writing surface when opened to the writing position. Here the locking means is a single concavity 24 molded into one of the frame members with a corresponding convexity molded into the adjacent frame member. The convex or concave shape may be molded into either frame member as long as the mating shape/recess is complementary. FIG. 11 is an isometric view of the two outer frame members 12, 14 joined by a living hinge 40 with the writing surfaces removed for clarity. The portion of each frame member that is joined by the living hinge may be thought of as a bridge running centerwise and longitudinally over the passageway formed by the aligned compartments 34 when the clipboard is opened in the writing position. Media 36 in the form of paper stock is shown being inserted via opening 44 into the compartments 34 passing beneath the portion of the bridge where the left and right frame members are joined by living hinge 40. FIG. 11*a* shows in detail, a molded recess 52 formed into the right frame member 14 and a peripheral ledge 52*a*, both also present in the former embodiment, which together receive a dimensioned panel of sheet stock; either plastic or metallic, to produce the writing surfaces 12*f*, 14*f*. The panel may be friction fitted, or permanently affixed to the frame members.

Figure 1:
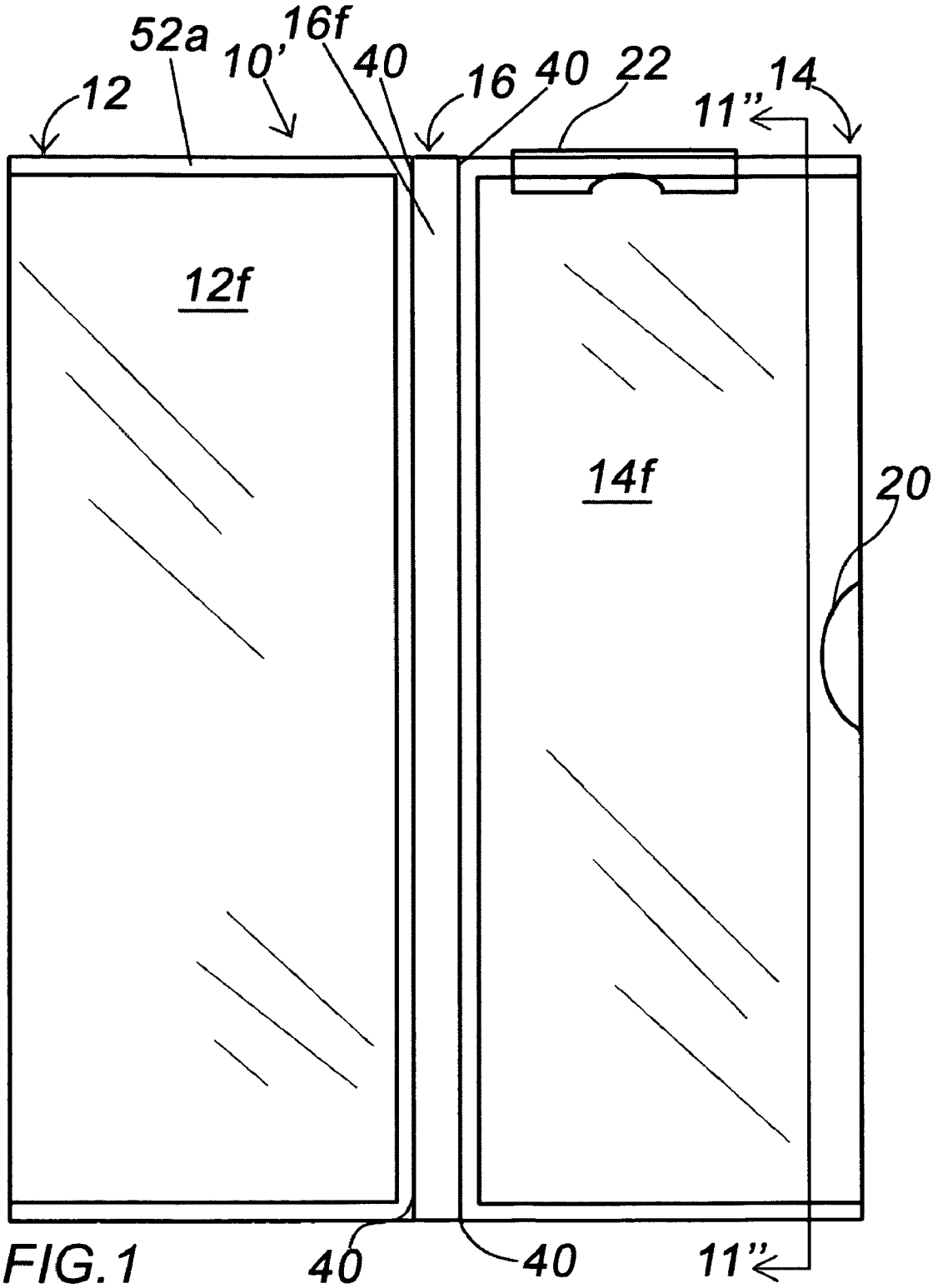
FIG. 1 is a plan view of a front side of a preferred embodiment according to the present invention.

FIG. 8 is a rear plan view of the embodiment shown in FIG. 1 with rear surfaces 12*r*, 14*r* of the frame members omitted, along with the deformable cover 18, for conciseness and clarity. The portion of the center frame member 16 exposed at the rear top and bottom sides of the clipboard separates the two outer frame members 12, 14. Lines 28 indicate the mating lines between the convexities 26 and concavities 24 formed in the frame sections. The outer frame members hingeably separate from the center frame member along lines 42 when folded.

Figure 15:
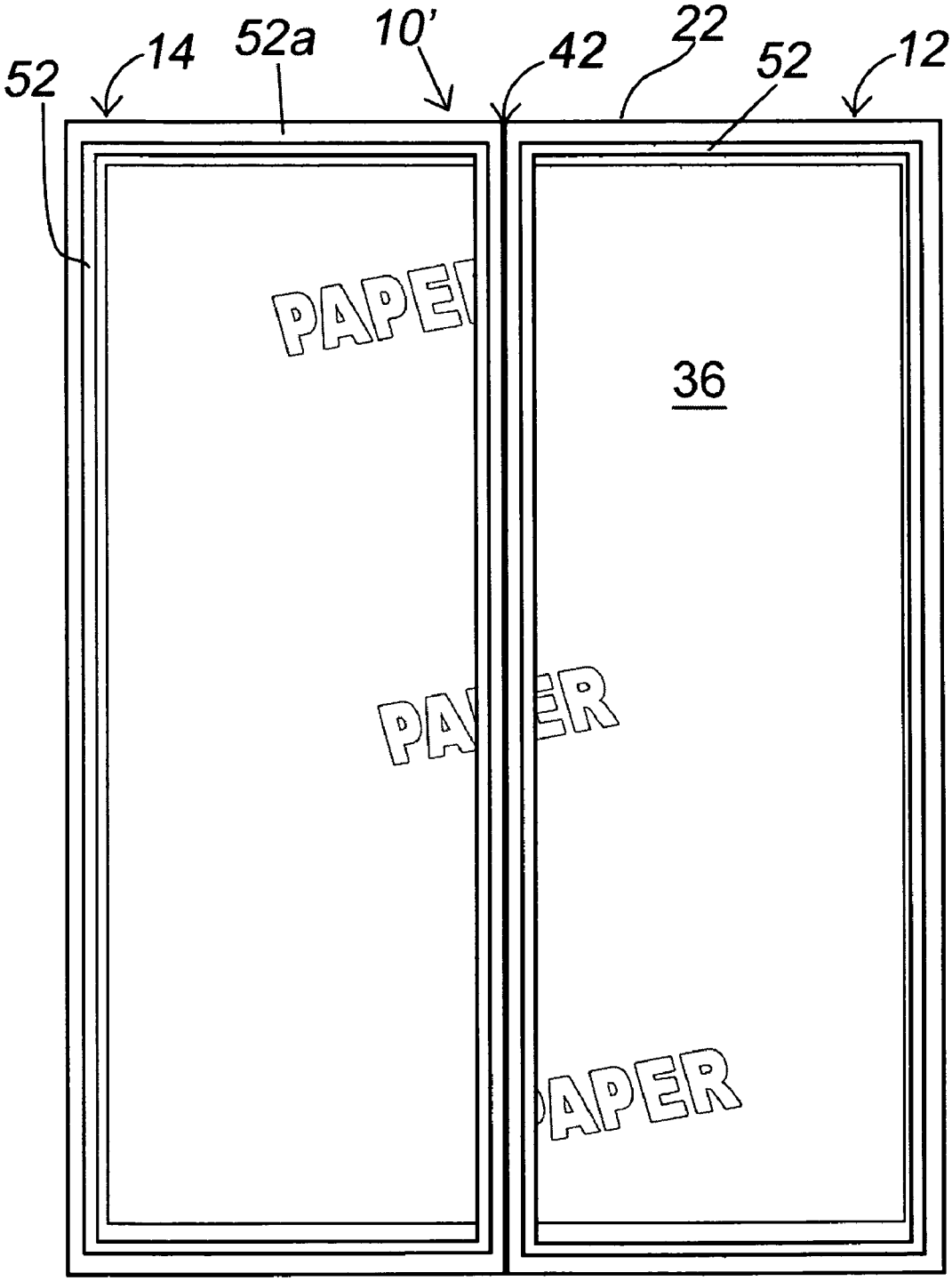
FIG. 15 is a plan view of the rear side of the embodiment shown in FIG. 10, according to the present invention.

FIG. 15 is a rear plan view of the embodiment shown in FIG. 9 with the rear surfaces 12*r*, 14*r* of the outer frame members and the deformable cover 18 omitted for conciseness and clarity. In this case, the center frame member has been reduced to a single living hinge on the front side of the clipboard, so is not visible from the rear side. The left and right frame members abut one another along the center line of the clipboard which is the living hinge 40 on the front side and separation line 42 on the rear side.

Preferably the writing surfaces 12*f*, 14*f* are panels of dimensioned sheet stock of either plastic or metallic composition. Although adding the writing surfaces separately offers advantages due to the superior rigidity obtainable with thin plastic or metallic sheet stock, it is also possible to simply omit the recess 52 and ledge 52*a* and mold the clipboard assembly with in-situ writing surfaces.

Preferably rear surfaces 12*r*, 14*r* are molded unitarily with the frame members, however, they may be panels of dimensioned sheet stock like that of the writing surfaces and fit into a recess 52 on the rear side of the sections as shown in FIG. 8 and FIG. 15. Ledge 52*a* may also be beveled (not shown) to receive a panel with a complementary edge angle, and slid into place with a friction fit, or it may be a right angle relative to the recess 52 with the panels seated within the recess, with the face of the panels flush with the face of the ledge and adhered to the frame members by adhesives, or the recess 52 and ledge 52*a* may simply be omitted in favor of a flat surface on the frame members and the panels flush mounted thereon. The panels may be transparent; such as clear acrylic so that the stored contents of the compartment 34 may be viewed, or opaque in the case of a metallic panel. A non-limiting list of appropriate thermoplastics for the frame members and the writing surfaces typically includes polymers of: polyethylene, polystyrene, nylon, polycarbonate and polypropylene. If the rear surfaces are unitarily injection molded or blow molded, such a span may employ structural support in the form of internal ribbing (not shown) to lend overall rigidity to the article. Additionally, readily available metal based masterbatch mixtures incorporating nano silver or titanium dioxide for example, may be added during the production process to all members of the clipboard providing antimicrobial characteristics which may confer benefits especially desirable in a clinical setting.

Figure 16:
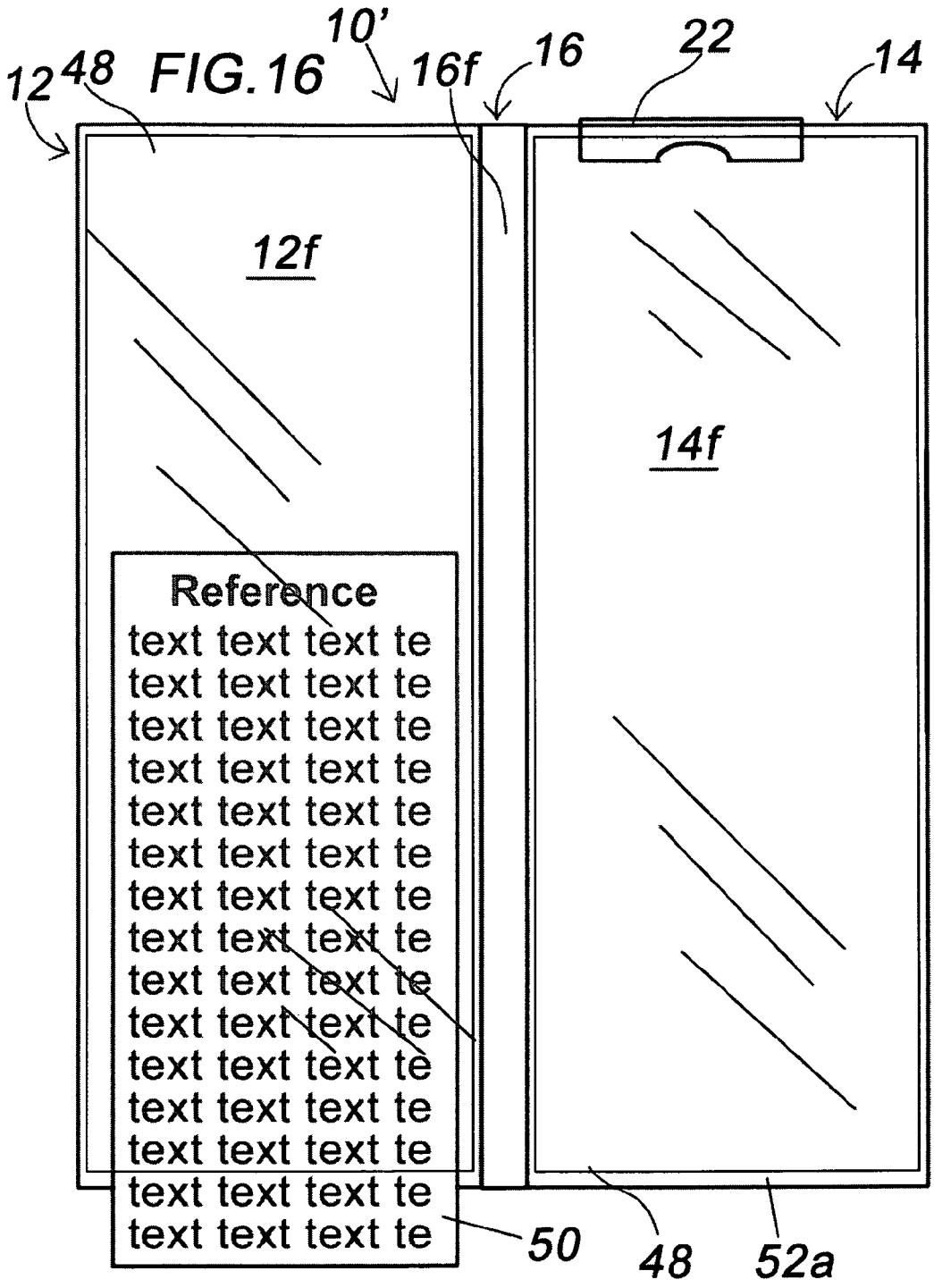
FIG. 16 is a front plan view of the embodiment shown in FIG. 1, according to the present invention showing a clear cover over the writing surfaces forming a sleeve for the insertion therein of reference materials.

FIG. 16 is another embodiment according to the present invention where a clear plastic or vinyl cover 48 is adhered along its edges to the writing surfaces 12*f*, 14*f* of the outer frame members with at least one edge of the cover unaffixed, so as to form a pocket or sleeve for the insertion of reference material 50 which in a non-limiting example might be a list of diagnostic tests and normal ranges for the convenience of a diagnostician.

Although this invention has been described above with reference to particular means, materials and embodiments, it is to be understood that the invention is not limited to the disclosed particulars, but extends instead to all equivalents within the scope of the following claims.

I claim:

1. A longitudinally folding compartmentalized clipboard:

1) at least two frame members connected one to the other by at least one living hinge, with at least one writing surface on each frame member and at least one rear surface on each frame member, and, at least one compartment within each frame member between the at least one writing surface and the at least one rear surface, and, at least one of the frame members having an opening for the insertion of paper and other articles; and, 2) a writing position in which the frame members are substantially inline relative to each other producing a planar surface for writing; and, 3) a passageway created by the writing position into which papers may be inserted, via the opening, and retained in the at least one compartment in each frame member; and, 4) a releasable friction fit locking mechanism formed in the frame members to secure the sections in the writing position.

2. The compartmentalized clipboard according to claim 1 in which the at least one compartment forms a portion of an uninterrupted passage for the insertion of papers when the frame members are aligned to form the writing position.

3. The compartmentalized clipboard according to claim 1. in which the friction fit locking mechanism further comprises at least one pair of mate-able male and female shapes molded into the frame members for the friction fit locking of the frame members when aligned to form the writing position.

4. The compartmentalized clipboard according to claim 1 in which a center frame member is positioned between, and hingeably joined to two adjacent frame members.

5. The compartmentalized clipboard according to claim 1 in which a deformable cover is connected to and spans a gap between the at least one rear surface on each frame member.

6. The compartmentalized clipboard according to claim 1 having at least one clear plastic cover over the at least one writing surface of the clipboard, the underside of the clear plastic cover being accessible in order to slide materials between the plastic cover and the front side of the clipboard.

7. The compartmentalized clipboard according to claim 1 having a plurality of compartments within for the retention of small articles such as papers, pens and paperclips.

8. The compartmentalized clipboard according to claim 1 having a closure to retain the compartmentalized clipboard in a closed position.

* * * * *